US010283879B2

(12) United States Patent
Dendas et al.

(10) Patent No.: US 10,283,879 B2
(45) Date of Patent: May 7, 2019

(54) INSULATION DISPLACEMENT CONTACT DEVICE WITH A BIASING ELEMENT

(71) Applicant: TE Connectivity Nederland BV, s'Hertogenbosch (NL)

(72) Inventors: Freddy Jean Philip Dendas, Genk (BE); Olaf Leijnse, Asten/RD (NL)

(73) Assignee: TE Connectivity Nederland BV, s-Hertogenbosch (NL)

( * ) Notice: Subject to any disclaimer, the term of this patent is extended or adjusted under 35 U.S.C. 154(b) by 0 days.

(21) Appl. No.: 15/697,822

(22) Filed: Sep. 7, 2017

(65) Prior Publication Data

US 2018/0069328 A1 Mar. 8, 2018

(30) Foreign Application Priority Data

Sep. 7, 2016 (EP) ..... 16187613

(51) Int. Cl.

| | |
|---|---|
| ***H01R 4/24*** | (2018.01) |
| ***H01R 4/26*** | (2006.01) |
| ***H01R 11/20*** | (2006.01) |
| ***H01R 4/2425*** | (2018.01) |
| ***H01R 4/2416*** | (2018.01) |
| ***H01R 4/2433*** | (2018.01) |
| ***H01R 43/01*** | (2006.01) |
| *H01R 4/2454* | (2018.01) |
| *H01R 13/05* | (2006.01) |

(52) U.S. Cl.

CPC ..... *H01R 4/2425* (2013.01); *H01R 4/2416* (2013.01); *H01R 4/2433* (2013.01); *H01R 43/01* (2013.01); *H01R 4/2454* (2013.01); *H01R 13/052* (2013.01)

(58) Field of Classification Search

CPC .... H01R 4/245; H01R 4/2455; H01R 4/2454; H01R 4/2425; H01R 4/2416; H01R 4/2462; H01R 4/2457

USPC ..... 439/395, 396, 404, 276

See application file for complete search history.

(56) References Cited

U.S. PATENT DOCUMENTS

| | | | | |
|---|---|---|---|---|
| 3,634,605 A * | 1/1972 | Dola | ..... | H01R 4/70 174/88 R |
| 4,274,198 A * | 6/1981 | Bouley | ..... | H01R 4/2433 29/866 |
| 4,740,171 A * | 4/1988 | Holden | ..... | H01R 4/2454 439/191 |

(Continued)

FOREIGN PATENT DOCUMENTS

| | | |
|---|---|---|
| DE | 8514963 U1 | 9/1986 |
| DE | 10201113327 A1 | 11/2012 |

(Continued)

OTHER PUBLICATIONS

European Search Report, dated Feb. 6, 2017, 8 pages.
Abstract of DE102011103327, dated Nov. 29, 2012, 1 page.

*Primary Examiner* — Hae Moon Hyeon
(74) *Attorney, Agent, or Firm* — Barley Snyder

(57) ABSTRACT

An insulation displacement contact device comprises a blade assembly and a biasing element. The blade assembly has a plurality of blades disposed opposite one another each with a cutting edge. The cutting edges of the blades terminate into a contact slot disposed between the blades. The blade assembly is disposed in the biasing element. The biasing element is movable with respect to the blade assembly along a moving direction parallel to the contact slot.

18 Claims, 9 Drawing Sheets

(56) References Cited

U.S. PATENT DOCUMENTS 4,749,366 A * 6/1988 McCaffery ..... H01R 4/245 439/396
5,112,244 A * 5/1992 Kuzuno ..... H01R 4/2454 439/395
5,581,879 A * 12/1996 Tsuji ..... H01R 43/01 29/33 M
5,827,087 A * 10/1998 Yamasaki ..... H01R 4/2425 439/395
6,027,361 A 2/2000 Burmeister et al.
6,527,580 B1 3/2003 Suss et al.
6,540,544 B1 * 4/2003 Akeda ..... H01R 4/2429 439/395
6,722,914 B2 * 4/2004 Blaha ..... H01R 4/2433 439/107
6,875,043 B2 * 4/2005 Turek ..... H01R 4/2454 439/397
6,893,280 B2 * 5/2005 Thompson ..... H01R 4/2433 439/276
7,736,165 B2 * 6/2010 Bukovnik ..... H01R 4/36 439/276
7,753,716 B2 * 7/2010 Cox ..... H01R 4/2433 439/276
7,976,334 B2 * 7/2011 Bishop ..... H01R 4/2433 439/395
8,109,783 B2 * 2/2012 Bishop ..... H01R 12/71 439/404
8,251,737 B2 * 8/2012 Van Stiphout ..... H01R 9/24 439/404
8,568,157 B2 * 10/2013 Bishop ..... H01R 4/2433 439/389

FOREIGN PATENT DOCUMENTS

EP 0893845 A2 1/1999
EP 2747206 A1 6/2014

* cited by examiner

INSULATION DISPLACEMENT CONTACT DEVICE WITH A BIASING ELEMENT

CROSS-REFERENCE TO RELATED APPLICATION

This application claims the benefit of the filing date under 35 U.S.C. § 119(a)-(d) of European Patent Application No. 16187613.1, filed on Sep. 7, 2016.

FIELD OF THE INVENTION

The present invention relates to a contact device and, more particularly, to an insulation displacement contact device electrically connecting a cable having a jacket and a conductor.

BACKGROUND

Insulation displacement contacts electrically contacting a conductor by piercing an insulation layer around the conductor are generally known in the art. The insulation displacement contact ("IDC") has opposite blades each with a cutting edge. The cutting edges terminate into a contact slot defined between the blades.

European Patent Application No. 0893845 discloses an IDC device having a biasing element. The blade and the biasing element are separate components made from sheet metal. The biasing element is U-shaped and is disposed at both sides of the blade at a position in which the conductor is received and electrically contacted within the contact slot. The blade has recesses receiving the biasing element to thereby obtain a form-fit connection between the blade and the biasing element. While the IDC device known from EP 0893845, via the biasing element, provides an improved clamping and thereby contact force between the blade and the conductor, connecting the cable requires an increased force to spread the blades for inserting, for example, multiple strands of a connector into the contact slot.

U.S. Pat. No. 6,540,544 discloses an IDC device with opposing blades and a hollow body portion movable along an extension of the contact slot. The body portion has a press-fitting rod adapted to cooperate with a conductor. The body portion supports blade pressing portions suspended in an internal space of the hollow body portion through springs and contacting upper surfaces of the blade. During the insertion of the conductor into the contact slot, the blades tilt slightly under contact with the blade pressing portions to render the geometry of the contact slot funnel shape, thereby facilitating the insertion of the conductor. After the conductor is received within the slot, the elastic forces of the springs provide a rectangular contact slot and compress the strands of the conductor within the contact slot. This arrangement of the blades is secured by a form-fit between the blades and the blade pressing portions.

The device described in U.S. Pat. No. 6,540,544 has numerous components and is large, and consequently, is expensive to manufacture. Furthermore, the device does not permit packing of strands of the conductor in the contact slot sufficient for transmitting high currents, such as in electrical connections for solar cables.

SUMMARY

An insulation displacement contact device according to the invention comprises a blade assembly and a biasing element. The blade assembly has a plurality of blades disposed opposite one another each with a cutting edge. The cutting edges of the blades terminate into a contact slot disposed between the blades. The blade assembly is disposed in the biasing element. The biasing element is movable with respect to the blade assembly along a moving direction parallel to the contact slot.

BRIEF DESCRIPTION OF THE DRAWINGS

The invention will now be described by way of example with reference to the accompanying Figures, of which.

DETAILED DESCRIPTION OF THE EMBODIMENTS

Figure 1:
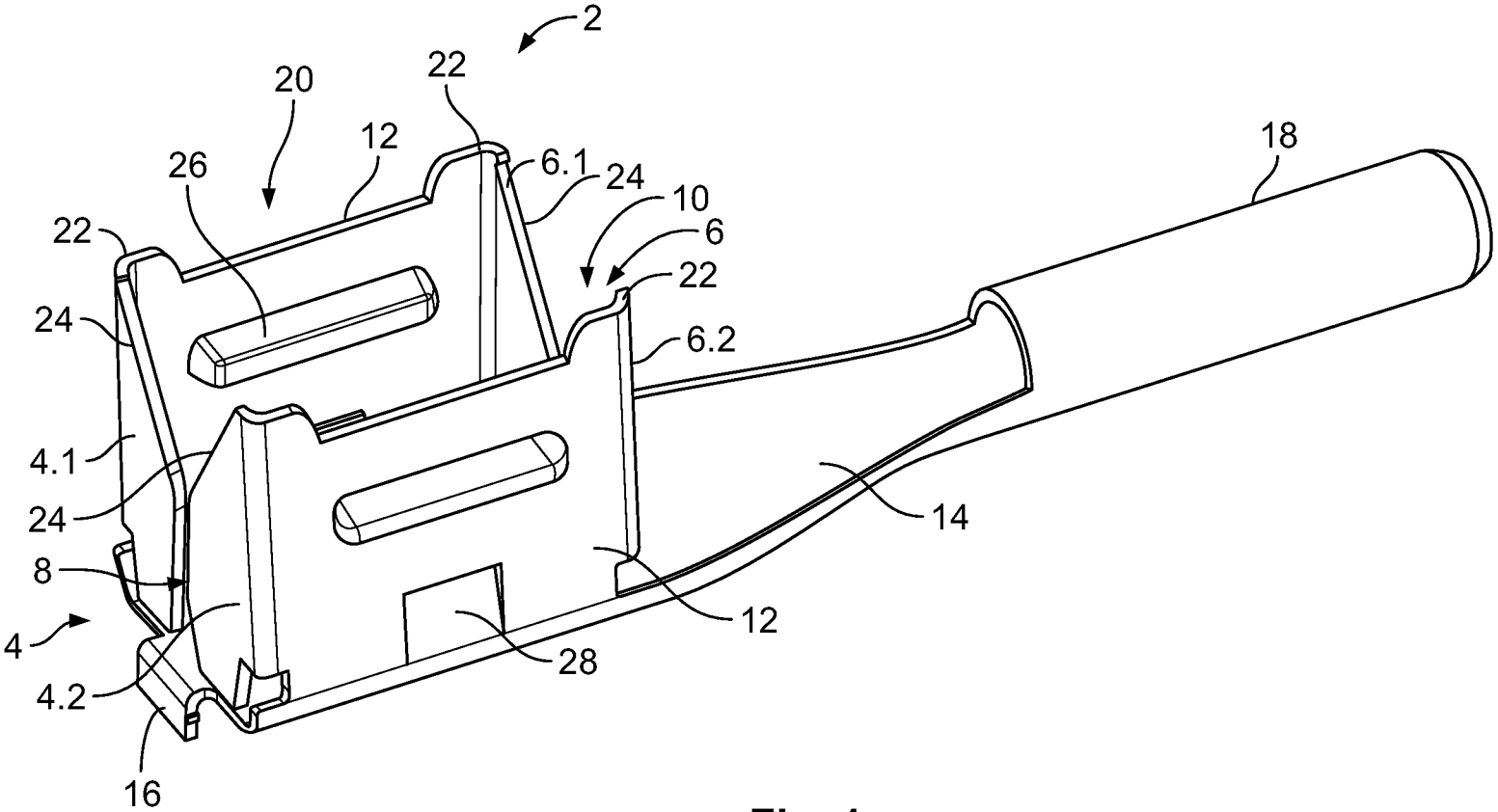
FIG. 1 is a perspective view of a blade assembly of an IDC device according to the invention.

Embodiments of the present invention will be described hereinafter in detail with reference to the attached drawings, wherein like reference numerals refer to the like elements.

The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 5:
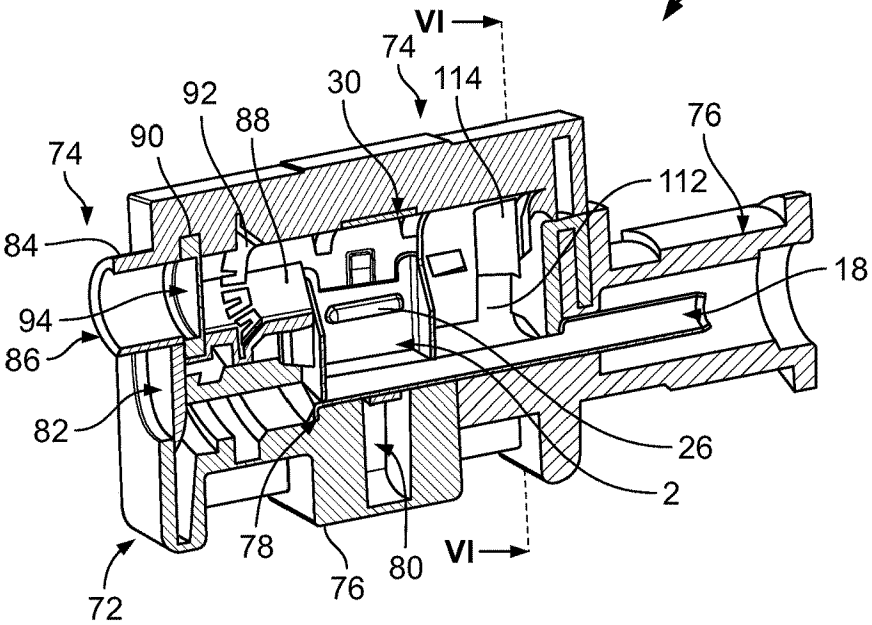
FIG. 5 is a sectional perspective view of the IDC device according to the invention.
Figure 8:
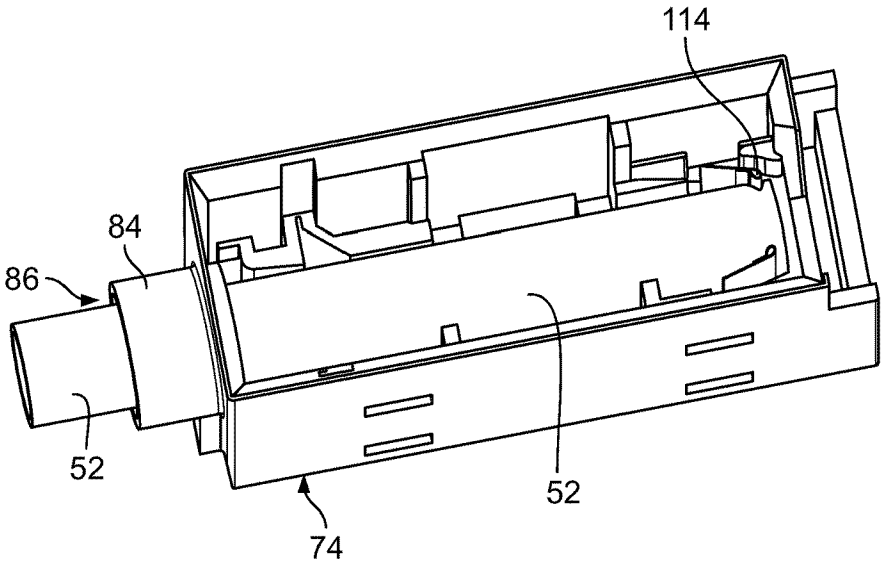
FIG. 8 is a perspective view of a housing cover of a housing of the IDC device.

An insulation displacement contact ("IDC") device according to the invention is shown generally in FIG. 5. The IDC device comprises a blade assembly 2, a biasing element 30, and a housing 70. The major components of the invention will now be described in greater detail.

The blade assembly 2, as shown in FIG. 1, has a pair of blade sets 4, 6, a pair of lateral walls 12, and a blade base 14. The blade assembly 2 is monolithically formed from a unitary piece of sheet metal by cutting and bending. In an embodiment, the sheet metal is copper or a copper alloy material.

Each blade set 4, 6 includes two blades 4.1, 4.2 and 6.1, 6.2, respectively, arranged opposite to each other and forming there-between a contact slot 8, 10. A first portion 8 of the contact slot 8, 10 is formed between a first blade 4.1 and a second blade 4.2 of the first blade set 4, and a second portion 10 of the contact slot 8, 10 is formed between a first blade 6.1 and a second blade 6.2 of the second blade set 6.

The lateral walls 12, as shown in FIG. 1, are connected to the blade base 14 and are bent by a 90° angle relative to the blade base 14. The blade sets 4, 6 are connected to the lateral walls 12 at corner portions 22 of the lateral walls 12 and are bent by a 90° angle relative to lateral walls 12. At the corner portions 22, each blade set 4, 6 define a V-shaped configuration between opposing blades 4.1, 4.2; 6.1, 6.2, defining a cutting edge 24. Two opposing cutting edges 24 terminate into the contact slots 8, 10, respectively.

An upper free end of each lateral wall 12, as shown in FIG. 1, has a receptacle 20 recessed between corner portions 22. Protrusions 26, formed by deep drawing the sheet metal material, project inwardly from the lateral walls 12. Below the protrusions 26, the outer side of each lateral wall 12 has a lock receptacle 28. Apart from the protrusion 26 and the lock receptacle 28, the outer surface of the lateral walls 12 is flat.

The blade base 14, as shown in FIG. 1, has a fixation latch 16 on a first end and an integrated cylindrical plug 18 on an opposite second end. In the shown embodiment, the plug 18 is a four-pin variopin ("VP4") interconnect plug. The blades 4, 6 are connected to the blade base 14 only by the lateral walls 12.

Figure 2:
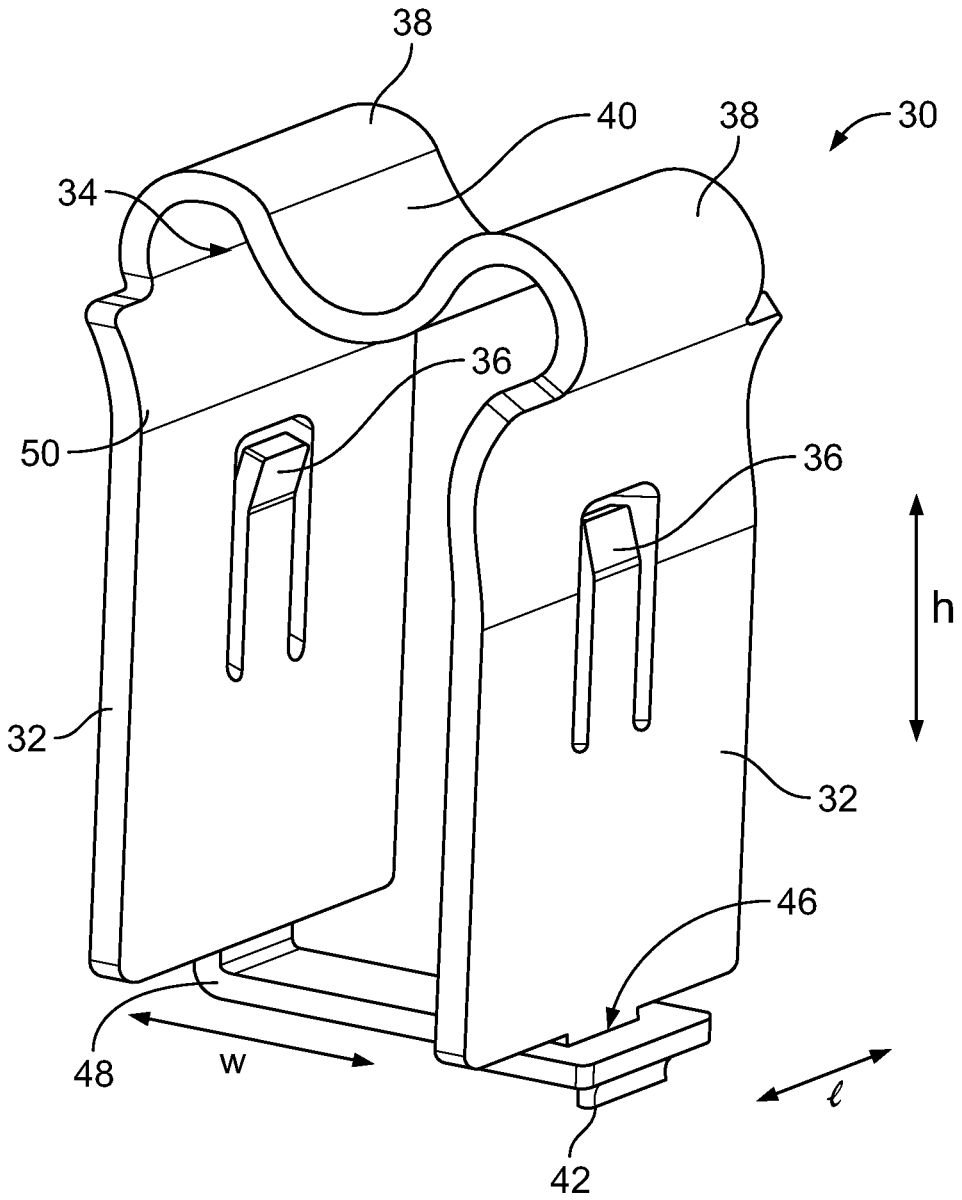
FIG. 2 is a perspective view of a biasing element of the IDC device.

The biasing element 30, shown in FIG. 2, has a generally U-shaped configuration with opposing legs 32 projecting from and being connected with a biasing base 34. Each leg 32 has a U-shaped cut-out extending essentially in a height direction h to define resilient cantilevers 36. Free ends of the resilient cantilevers 36 project slightly toward the inner opposing surfaces of the legs 32. The legs 32 have a larger dimension in length-direction 1 than the biasing base 34. The biasing base 34 has an undulated cross-section with convex corner sections 38 and a concave midsection 40. The convex corner sections 38 store an elastic deformation of the legs 32 as they are bent outwardly.

Ends of the legs 32 are connected opposite the biasing base 34 by a form-fit closure; a securing latch 42 projects into a securing recess 46 disposed at a free end of a securing leg 48 extending generally perpendicular to the legs 32. In other embodiments, the connection formed by the securing leg 48 may be omitted.

The legs 32, as shown in FIG. 2, each have a convex protrusion 50 disposed slightly above the free end of the resilient cantilevers 36 in the height direction h. The convex protrusions 50 are level in the height direction h and project from the generally flat surface of the leg 32. The convex corner sections 38 extend from these convex protrusions 50. The outer surface of each leg 32 slightly above the resilient cantilever 36 thus is concave at the convex protrusion 50 and convex at the convex corner section 38.

The use of the blade assembly 2 and biasing element 30 to cut and electrically connect to a cable 52 is show in FIGS. 3*a*-3*d*.

Figure 3D:
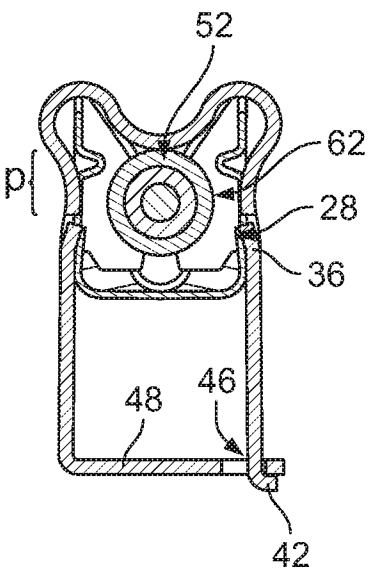
FIG. 3*d* is a front view of a fourth step of the blade assembly of FIG. 1 and the biasing element of FIG. 2 connecting to the cable.
Figure 3C:
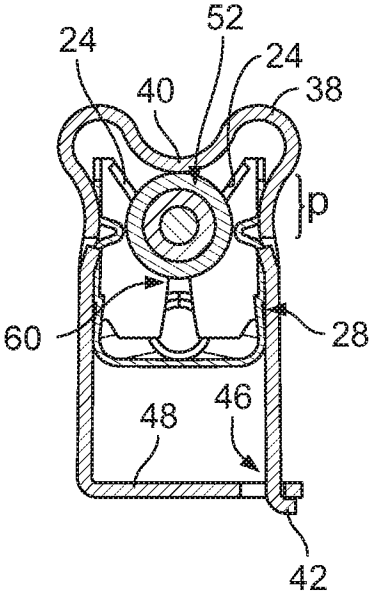
FIG. 3*c* is a front view of a third step of the blade assembly of FIG. 1 and the biasing element of FIG. 2 connecting to the cable.
Figure 3B:
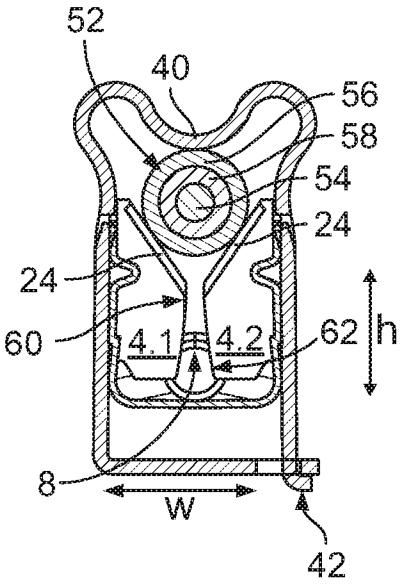
FIG. 3*b* is a front view of a second step of the blade assembly of FIG. 1 and the biasing element of FIG. 2 connecting to the cable.
Figure 3A:
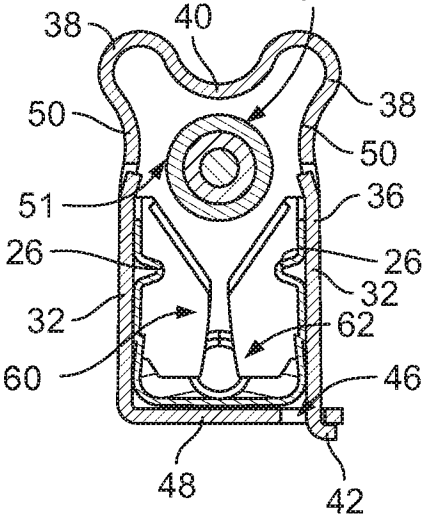
FIG. 3*a* is a front view of a first step of the blade assembly of FIG. 1 and the biasing element of FIG. 2 connecting to a cable.

The biasing element 30 is shown mounted on the blade assembly 2 in an insertion position in FIG. 3*a*. In the insertion position, the blade assembly 2 is disposed in a space defined by the legs 32, the biasing base 34, and the securing leg 48. The biasing base 34 is disposed with a sufficient distance above the cutting edges 24 to allow the cable 52 to be inserted between the biasing base 34 of the biasing element 30 and the blade assembly 2. A space above the cuttings edges 24 and below the biasing base 34 of the biasing element 30 defines an insertion opening 51 adapted to receive the cable 52. In this insertion position, the free ends of the resilient cantilevers 36 project toward the blade assembly 2.

The cable 52, as shown in FIGS. 3*a*-3*d*, is a 14-AWG solar cable with a conductor 54 formed by a plurality of individual strands each having a diameter of 0.25 mm and a jacket 56 having an outer diameter of 5.65-6.18 mm. The conductor 54 has at least thirty-five strands. The jacket 56 surrounds an insulation 58. The cable 52 is a doubly isolated cable.

In all positions shown in FIGS. 3*a*-3*d*, the biasing base 34 extends across the blade assembly 2 and perpendicular to the height direction in which the biasing element 30 is moved. The biasing element 30 is moved with respect to the blade assembly 2 in a moving direction parallel to the height direction h and parallel to the extension of the contact slot 8, 10, in accordance with the sequence of FIG. 3*a*-3*d*. This sliding movement is guided by the outer surface of each lateral wall 12 cooperating with the inner opposing surfaces of the legs 32.

After insertion of the cable 52, the biasing element 30 is pushed downwardly toward the blade assembly 2, as shown in FIGS. 3*b*-3*d*. In the course of this movement, the biasing base 34, specifically the concave midsection 40 of the biasing base 34 comes into contact with the outer circumference of the cable 52 and forces the cable 52 towards the cutting edges 24, as shown in FIG. 3*b*. As the biasing element 30 is further advanced toward the blade assembly 2, the cutting edges 24 will cut jacket 56 and the insulation 58 to expose the conductor 54, as shown in FIG. 3*c*. This cutting terminated at the transition of the cutting edges 24 into the contact slot 8 or 10.

As the cable 52 is further advanced into the blade assembly 2, the conductor 54 passes a mouth 60 of the contact slot 8 defining a narrowest part of the contact slot 8. At this position, as shown in FIG. 3*d*, the individual strands of the conductor 54 are deformed to adapt to the configuration of contact slot 8 to arrange the strands of the conductor 54 within a contact area 62 defined between the blades 4.1, 4.2 and 6.1, 6.2, in a midsection of the contact slot 8.

As shown in FIGS. 3*a*-3*d*, a pressing zone p defined by the convex protrusions 50 is always level with the largest dimension of the cable 52 in a direction perpendicular to the contact slot 8, 10. The cutting performance of the cutting edges 24 and the pressing of the strands within the contact slot 8 are assisted by the elastic force of the biasing element 30 at the pressing zone p; a maximum lateral biasing force is imposed on the blade assembly 2 by the biasing element 30 at the pressing zone p. In the end position shown in FIG. 3*d*, resilient cantilevers 36 of each leg 32 are received within the lock receptacle 28 of the blade assembly 2 to provide a positive fit, securing the blade assembly 2 and biasing element 30 in the end position.

FIGS. 4*a*-4*d* show the same sequence of using the blade assembly 2 and biasing element 30 to cut and electrically connect to a cable 52'. The cable 52' is a 10-AWG cable which has an outer diameter of 7.23-6.68 mm and thus, a larger outer diameter than the 14-AWG cable 52 of FIGS. 3*a*-3*d*. The conductor 54 of the cable 52' has a diameter of 3.1 mm.

Figure 4B:
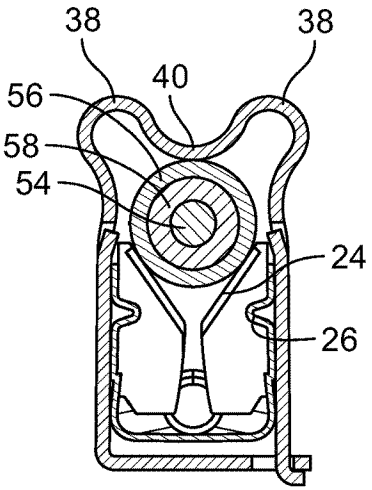
FIG. 4*b* is a front view of a second step of the blade assembly of FIG. 1 and the biasing element of FIG. 2 connecting to the cable.
Figure 4A:
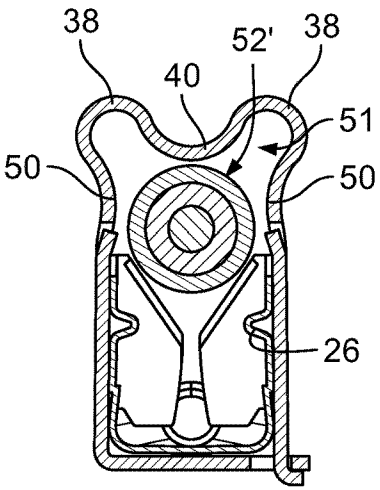
FIG. 4*a* is a front view of a first step of the blade assembly of FIG. 1 and the biasing element of FIG. 2 connecting to another cable.
Figure 4C:
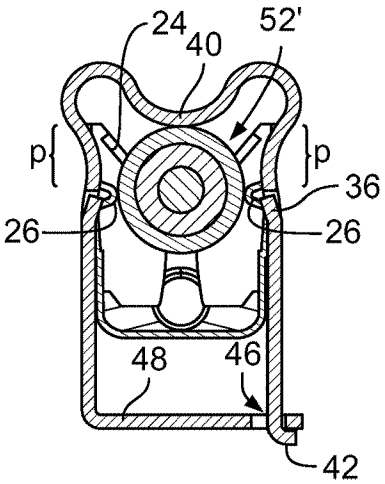
FIG. 4*c* is a front view of a third step of the blade assembly of FIG. 1 and the biasing element of FIG. 2 connecting to the cable.
Figure 4D:
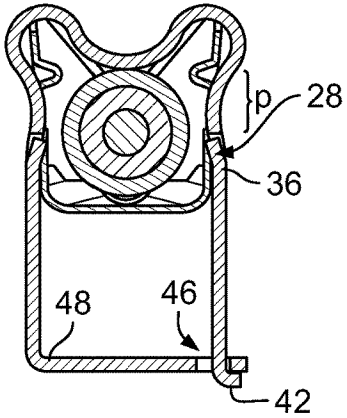
FIG. 4*d* is a front view of a fourth step of the blade assembly of FIG. 1 and the biasing element of FIG. 2 connecting to the cable.

To assist positioning of all strands of the cable 52' within the contact slot 8, 10, the outer diameter of the jacket 56 abuts the protrusions 26 as shown in FIG. 4*c* after the jacket 56 and insulation 58 have been completely cut to expose the conductor 54. The protrusions 26 deflect the opposing blades 4.1, 4.2; 6.1, 6.2 away from one another through the contact of the protrusions 26 with the cable 52'. At this position, and in the course of further advancing the conductor 54 into the contact slot 8, 10, the upper portions of the blades 4.1, 4.2; 6.1, 6.2 are allowed to flex outwardly within an area above the pressing zone p and under the convex corner portions 38, increasing a width of the contact slot 8, 10. These corner portions 38 provide room for a higher degree of movability of the blades 4.1, 4.2; 6.1, 6.2 and the lateral walls 12. Thus, a maximum lateral biasing force imposed on the blade assembly 2 by the convex protrusion 50 is not reduced by an inability of the blade assembly 2 to flex outwardly at the upper end thereof.

The IDC device is shown in FIG. 5 with the housing 70 receiving the blade assembly 2 and the biasing element 30. The housing 70 is formed of an insulative material such as a plastic. The housing 70 comprises a housing base 72 and a housing cover 74 which are slidable relative to each other from a start position shown in FIGS. 5 and 6 to a mounting position shown in FIG. 7. In the start position of the housing 70, the biasing element 30 and blade assembly 2 are in the insertion position shown in FIGS. 3*a* and 4*a*. In the mounting position of the housing 70, the biasing element 30 and blade assembly 2 are in the end position shown in FIGS. 3*d* and 4*d*.

The housing base 72, as shown in FIG. 5, has a cylindrical plug housing section 76 surrounding the plug 18 and adapted to guide a mating plug section of a mating housing to electrically and mechanically connect to the plug 18. The housing base 72 has a bottom provided with a fixation slot 78 receiving the fixation latch 16 to axially secure the blade assembly 2 within the housing base 72. Below the blade base 14, the housing base 72 defines a U-shaped receiving chamber 80 receiving the portions of the legs 32 projecting in a downward direction from the blade assembly 2 in the end position.

A front face of the housing base 72 opposite to the plug housing section 76 has a sliding slot 82 adapted to guide a cylindrical section 84 of the housing cover 74, as shown in FIG. 5. The cylindrical section 84 of the housing cover 74 defines an opening 86 for inserting a cable into the housing cover 74. In the mounting position, the outer circumference of the cylindrical section 84 abuts a semi-circular termination of the sliding slot 82.

Between the cylindrical section 84 and the blade assembly 2, as shown in FIG. 5, the housing cover 74 is connected with a channel member 88 which receives a sealing element 90 and a retention spring 92. The channel member 88 circumferentially encloses a channel 94 guiding the cable 52 into the housing 70 and extending through the blade assembly 2.

Figure 9B:
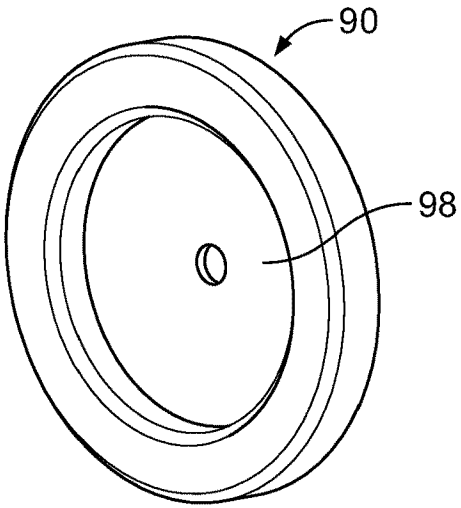
FIG. 9*b* is a perspective of a second embodiment of a sealing element of the housing cover.
Figure 9A:
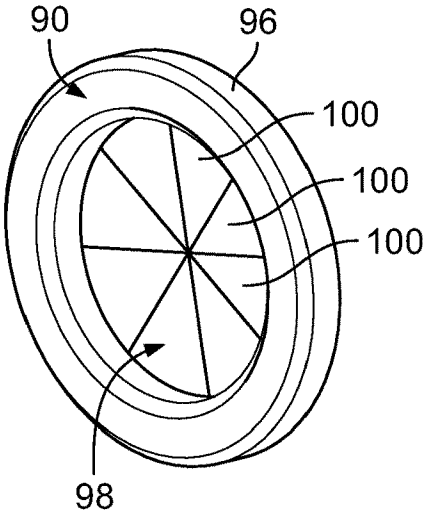
FIG. 9*a* is a perspective view of a first embodiment of a sealing element of the housing cover.

The sealing element 90, as shown in FIG. 9*a*, is disc-shaped and has a stiffening ring 96 closed by a pre-cut membrane 98. The pre-cut membrane 98 provides a closed sealing surface prior to insertion of the cable 52 and can be penetrated along the cutting lines of pre-cut membrane 98 to separate segments 100 of the membrane 98. In another embodiment shown in FIG. 9*b*, the sealing element 90 has a membrane 98 which is not cut and has only a small opening which is widened and sealingly abutted against the outer circumference of the cable 52 to seal the cable 52.

Figure 10:
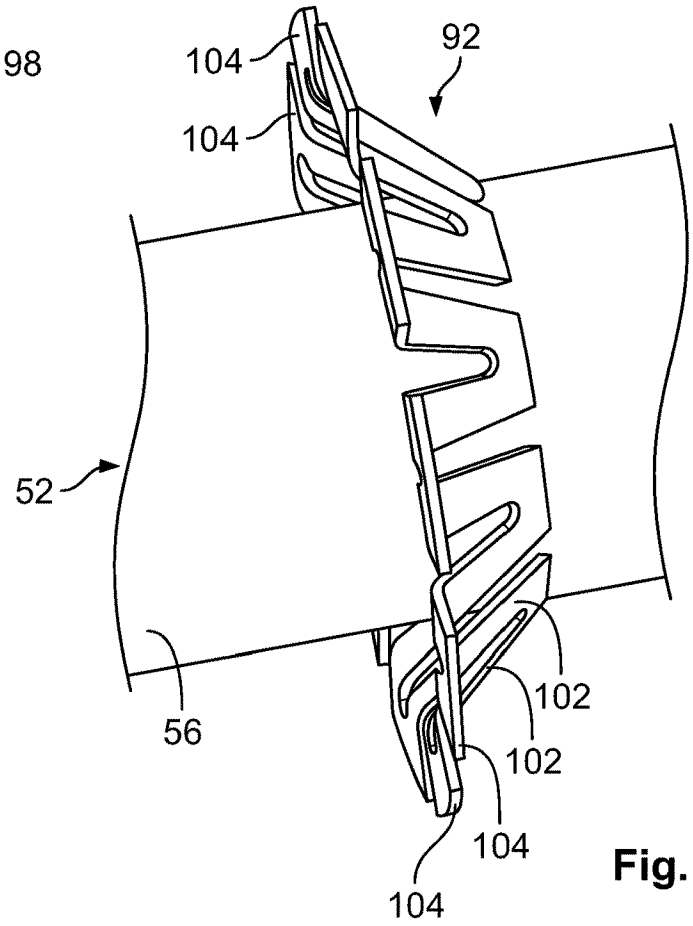
FIG. 10 is a perspective view of a retention spring of the housing cover.

The retention spring 92, as shown in FIG. 10, has a plurality of spring arms 102 formed by cutting and projecting from ring segments 104. A sheet metal material defining the retention spring 92 is stamped and bent to provide the U-shaped spring arms 102 extending radially inwardly from the ring segments 104. In the initial state, prior to inserting the cable, the spring arms 102 may lie in a plane together with the ring segments 104 or may be bent out of the plane containing the ring segments 104 to extend in the longitudinal and insertion direction of the cable and be bent relative to the ring segments 104 by an angle of at least 10°. This bending is effected or further enhanced by the diameter of the cable 52 inserted into the retention spring 92. In the embodiment shown in FIG. 10, the diameter of the cable 52 is fairly large and the spring arms 102 have been bent by a bending angle of about 45°. Free ends of the spring arms 102 cut into the outer periphery of the jacket 56 to prevent the cable 52 from being withdrawn out of the retention spring 92. Accordingly, the retention spring 92 provides a thorough axial fixation of the cable 52 inserted into the housing 70.

Figure 6:
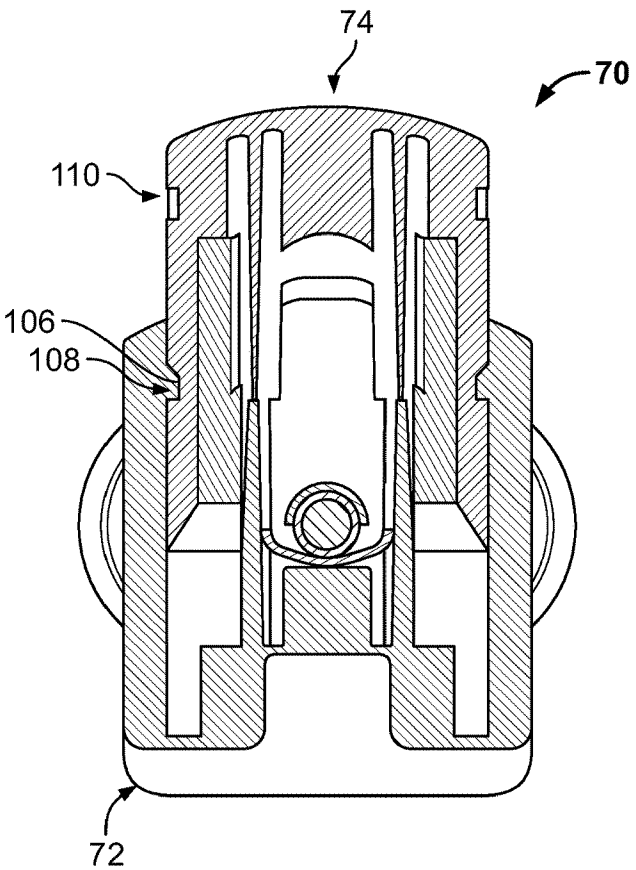
FIG. 6 is a sectional view of the IDC device in a start position taken along line VI-VI of FIG. 5.
Figure 7:
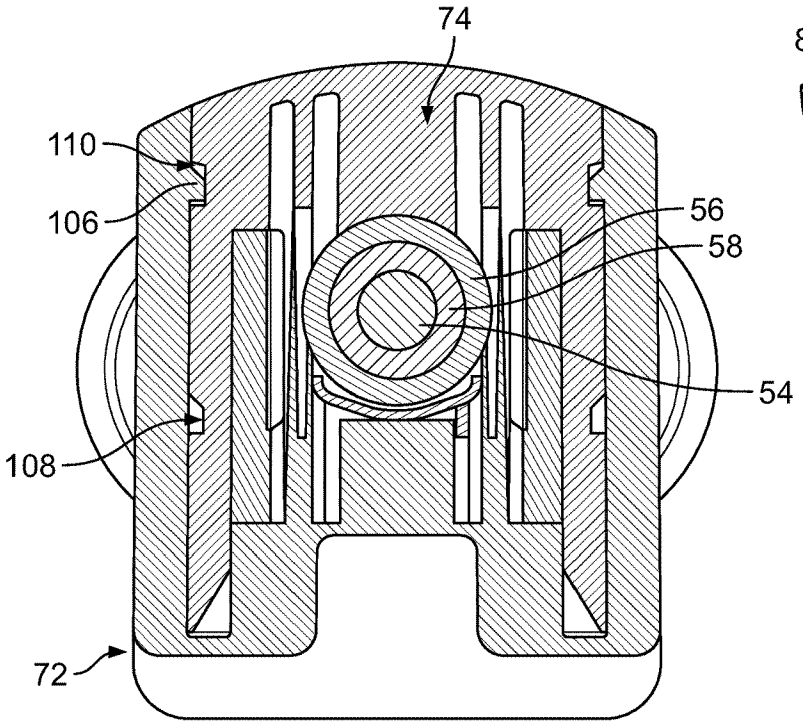
FIG. 7 is a sectional view of the IDC device in a mounting position taken along line VI-VI of FIG. 5.

The bottom of the housing base 72 is configured to receive the contours of the channel member 88 in the mounting position. The bottom of the housing base 72 is generally filled with gel sealing material which is squeezed into voids as the housing cover 74 is shifted from the start position into the mounting position. As shown in FIGS. 6 and 7, the housing base 72 has snapping projections 106 that cooperate with snapping receptacles 108, 110 disposed on the housing cover 74. The lower snapping receptacle 108 cooperates with the snapping projection 106 in the start position and thus secures the start position. Due to the inclined configuration of the upper walls defining the snapping projection 106 and the snapping receptacle 108, pushing against the housing cover 74 releases this snapping position and permits movement into the mounting position in which the upper snapping receptacle 110 cooperates with the snapping projection 106. As the surfaces defining the lower end of the snapping projection 106 are rectangular, the mounting position shown in FIG. 7 cannot be released.

In a corner portion opposite to the opening 86, as shown in FIG. 5, the housing base 72 has a rigid blocking wall 112 interacting with a flexible blocking flap 114. The blocking flap 114 is a unitary part of the housing cover 74 and is connected therewith through a film hinge. The blocking flap 114 has a distal free end and is allowed to flex outwardly. The blocking wall 112 and blocking flap 114 block the housing cover 74 from being pushed from the start position of FIG. 6 into the mounting position of FIG. 7 prior to inserting the cable 52 into the housing 70.

As the cable 52 is introduced through the opening 86, it passes the sealing element 90 and opens the pre-cut membrane 98. By further advancing the cable 52, it passes the retention spring 92 to flex the spring arms 102 in the moving direction of the cable 52. The cable 52 passes the blade assembly 2 and finally contacts the blocking flaps 114 arranged at the distal corner portions to disengage the blocking flaps 114 from the blocking walls 112. Thus, proper insertion of the cable 52 will allow the housing cover 74 to be pushed downwardly towards the housing base 72.

As the housing base 72 receives the housing cover 74, the gel sealing material received within the housing 70 is squeezed and thereby distributed within the remaining space within the housing 70 to fill all voids therein. The amount of gel sealing material received within the housing 70 is selected such that the gel sealing material essentially fills the entire space within the housing 70 in the mounting position. The gel sealing material is squeezed into the channel 94 and up to the sealing element 90.

As shown in FIGS. 5-8, the housing cover 74 receives the biasing element 30, which may be attached to the housing cover 74 by an adhesive and/or form-fit means. The housing base 72 receives the blade assembly 2. Sliding of the housing cover 74 towards the housing base 72 will lead to cutting of the jacket 56 and insulation 58 and to arrangement of the conductor 54 within the two contact slots 8, 10 in the mounting position.

Figure 11:
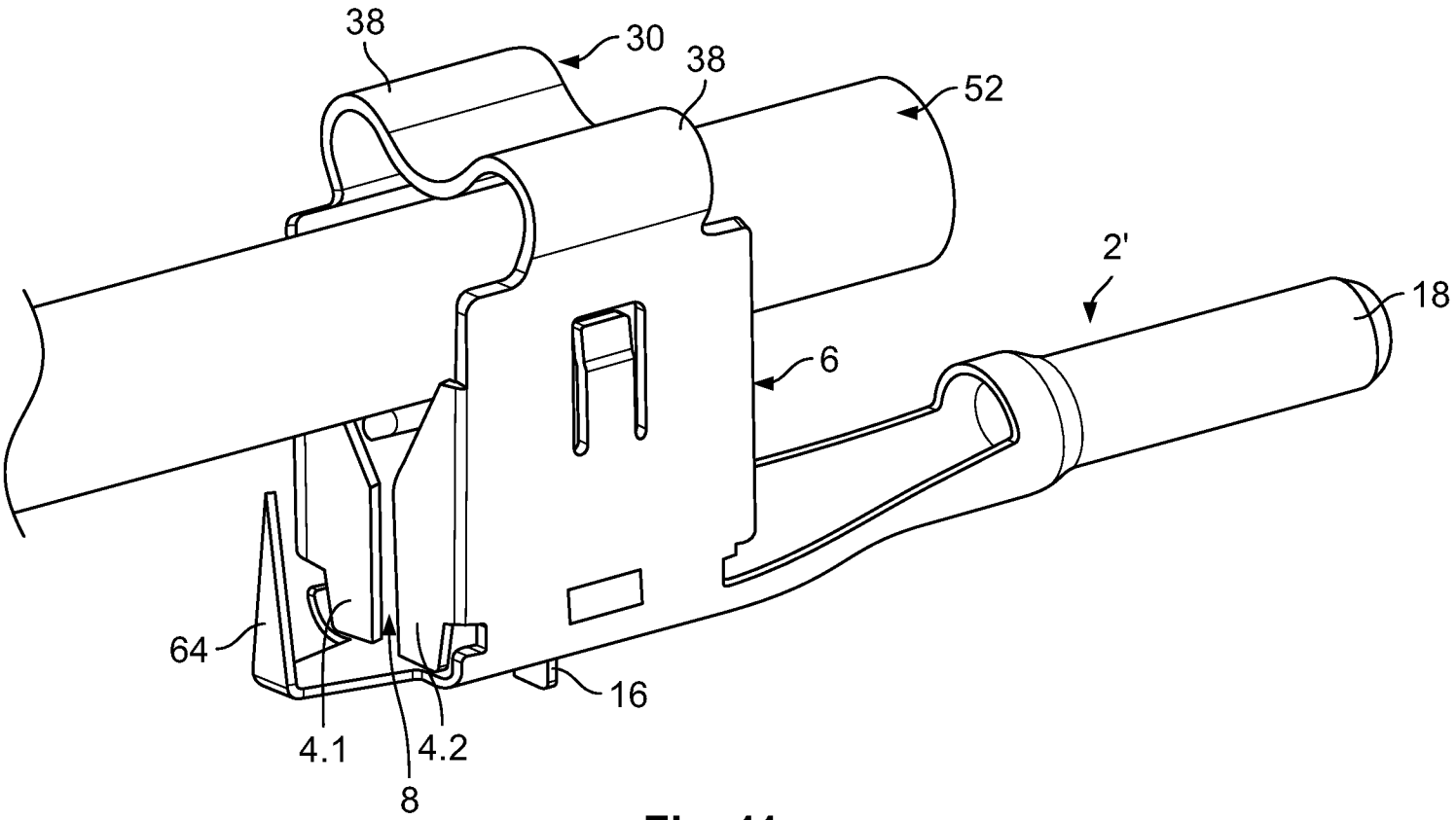
FIG. 11 is a perspective view of an IDC device according to another embodiment of the invention.

A blade assembly 2' according to another embodiment of the invention is shown in FIG. 11. The blade assembly 2' has the fixation latch 16 disposed essentially halfway between the two sets of blades 4, 6 while one end of the blade base 14 of the blade assembly 2 has a triangular shape and is bent upwardly to define a retention latch 64. The retention latch 64 extends essentially parallel to the extension direction of the contact slots 8, 10 and contacts the jacket 56 as the cable 52 is advanced toward the contact slot 8. In the end position, the retention latch 64 penetrates the jacket 56 to axially secure the cable 52 within the IDC device.

Figure 12B:
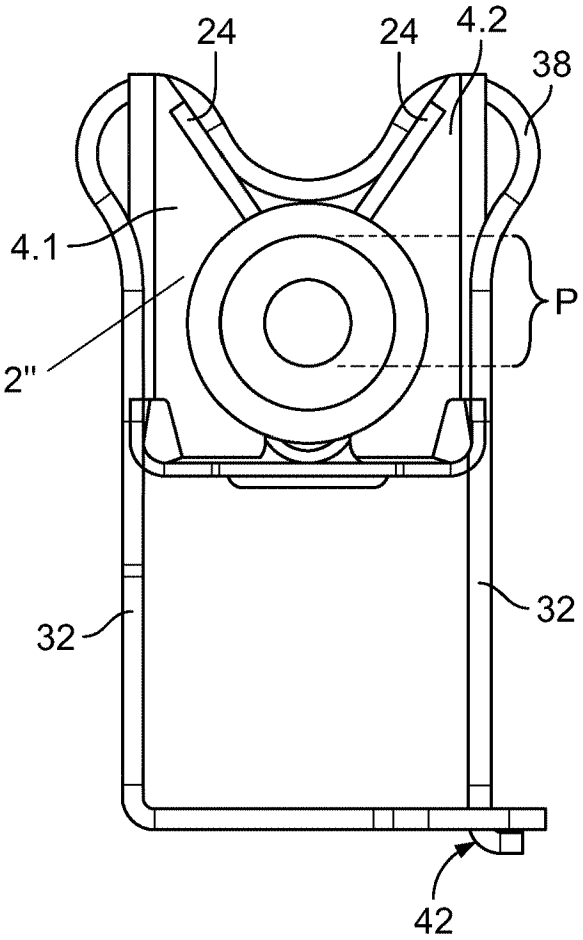
FIG. 12*b* is a front view of the IDC device of FIG. 12*a* in an end position.
Figure 12A:
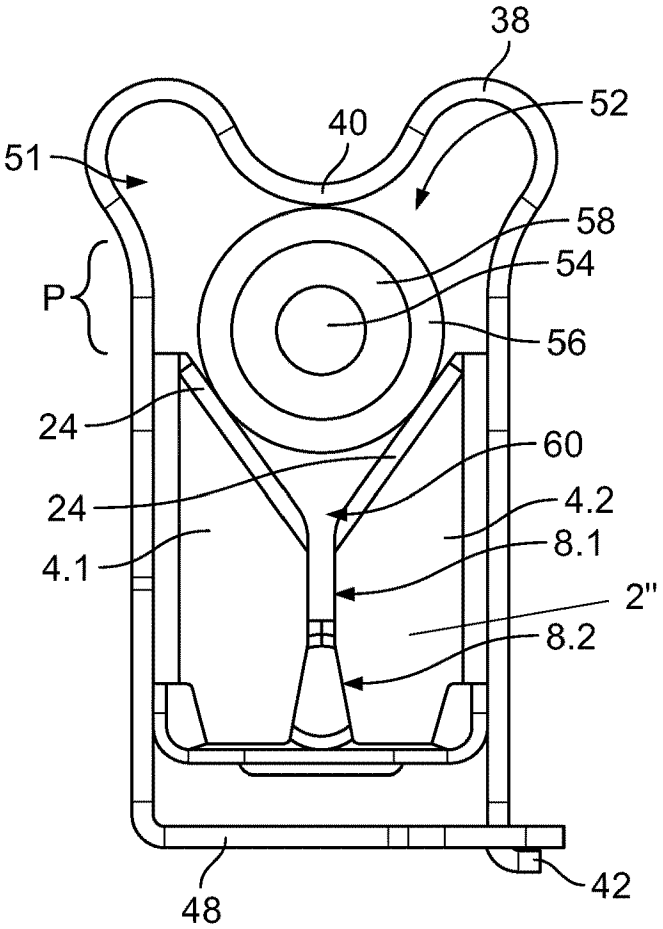
FIG. 12*a* is a front view of an IDC device according to another embodiment of the invention in an insertion position.

A blade assembly 2" according to another embodiment of the invention is shown in FIGS. 12*a* and 12*b*. The blade assembly 2" has a contact slot 8 with a rectangular slot section 8.1 and a slanted slot section 8.2. The rectangular slot section 8.1 follows the mouth 60 of the contact slot 8 in the insertion direction of the cable 52 and has a length corresponding at least to the diameter of the conductor 54. The slanted slot section 8.2 follows the rectangular slot section 8.1 and widens towards the lower end of the contact slot 8. The specific geometry of the contact slot 8 is to cope with the plastic deformation of the copper strands forming the conductor 54 in view of a rather excessive biasing force exerted by the biasing element 30.

What is claimed is:

1. An insulation displacement contact device, comprising:

a blade assembly having a plurality of blades disposed opposite one another each with a cutting edge, the cutting edges of the blades terminating into a contact slot disposed between the blades; and a biasing element in which the blade assembly is disposed, the biasing element movable with respect to the blade assembly along a moving direction parallel to the contact slot, the biasing element having a pair of opposing legs extending from a biasing base, each of the opposing legs has a convex protrusion contacting one of the blades at a pressing zone in which a maximum lateral biasing force is imposed on the blade assembly by the biasing element.

2. The insulation displacement contact device of claim 1, wherein the biasing element is U-shaped.

3. The insulation displacement contact device of claim 1, wherein the biasing base has a pair of convex corner sections connected to the legs and storing an elastic deformation of the legs.

4. The insulation displacement contact device of claim 1, wherein the biasing element is movable with respect to the blade assembly in the moving direction between an insertion position and an end position, a cable electrically connected to the blade assembly in the end position.

5. The insulation displacement contact device of claim 4, wherein an insertion opening is defined between the cutting edges and the biasing element in the insertion position, the cable insertable into the insertion opening.

6. The insulation displacement contact device of claim 5, wherein the blade assembly has a plurality of protrusions contacting an outer circumference of a jacket of the cable, contact of the jacket with the protrusions deflecting the blades away from one another and increasing a width of the contact slot.

7. The insulation displacement contact device of claim 4, wherein the biasing element has a resilient cantilever engaging a lock receptacle of the blade assembly in the end position and securing the biasing element to the blade assembly.

8. The insulation displacement contact device of claim 4, wherein the blade assembly has a pair of lateral walls and the plurality of blades include a pair of blade sets connected to the lateral walls.

9. The insulation displacement contact device of claim 8, wherein each of the lateral walls has a receptacle receiving the biasing element in the end position.

10. The insulation displacement contact of claim 4, wherein a mouth of the contact slot is narrower than a contact area of the contact slot receiving a conductor of the cable in the end position.

11. The insulation displacement contact of claim 1, wherein the blade assembly has a cylindrical plug.

12. A method for electrically connecting a cable with an insulation displacement contact device, comprising:

providing the insulation displacement contact device having a blade assembly including a plurality of blades disposed opposite one another each with a cutting edge, the cutting edges of the blades terminating into a contact slot disposed between the blades, and a biasing element in which the blade assembly is disposed;

inserting the cable into an insertion opening defined between the cutting edges and the biasing element; and moving the biasing element with respect to the blade assembly along a moving direction parallel to the contact slot to push the cable into the contact slot, the biasing element is movable with respect to the blade assembly in the moving direction between an insertion position and an end position, the cable is electrically connected to the blade assembly in the end position and the biasing element is secured to the blade assembly in the end position, the biasing element having a pressing zone in which the biasing element contacts the blade with a maximum lateral biasing force.

13. The method of claim 12, wherein the pressing zone remains level with a largest dimension of the cable in a direction perpendicular to the contact slot throughout the movement between the insertion position and the end position.

14. An insulation displacement contact device, comprising:

a blade assembly having a plurality of blades disposed opposite one another each with a cutting edge, the cutting edges of the blades terminating into a contact slot disposed between the blades; and a biasing element in which the blade assembly is disposed, the biasing element movable with respect to the blade assembly along a moving direction parallel to the contact slot between an insertion position and an end position, a cable electrically connected to the blade assembly in the end position, an insertion opening is defined between the cutting edges and the biasing element in the insertion position and the cable is insertable into the insertion opening, the blade assembly has a plurality of protrusions contacting an outer circumference of a jacket of the cable, contact of the jacket with the protrusions deflecting the blades away from one another and increasing a width of the contact slot.

15. An insulation displacement contact device, comprising:

a blade assembly having a plurality of blades disposed opposite one another each with a cutting edge, the cutting edges of the blades terminating into a contact slot disposed between the blades;

a biasing element in which the blade assembly is disposed, the biasing element movable with respect to the blade assembly along a moving direction parallel to the contact slot; and a housing formed of an insulative material and including a housing base and a housing cover slidable with respect to the housing base between a start position and a mounting position, the blade assembly is disposed within the housing base and the biasing element is disposed within the housing cover, a cable is inserted into the housing in the start position and the cable is electrically connected with the blade assembly in the mounting position, the housing base has a blocking wall and the housing cover has a blocking flap, the blocking flap contacting the blocking wall to prevent movement of the housing cover from the start position to the mounting position unless the cable is inserted into the housing and deflects the blocking flap.

16. The insulation displacement contact of claim 15, wherein a gel sealing material is disposed within the housing in the start position and seals the housing in the mounting position.

17. The insulation displacement contact of claim 15, wherein the housing cover has a retention spring contacting a jacket of the cable and retaining the cable in the housing.

18. An insulation displacement contact device, comprising:

a blade assembly having a plurality of blades disposed opposite one another each with a cutting edge, the cutting edges of the blades terminating into a contact slot disposed between the blades;

a biasing element in which the blade assembly is disposed, the biasing element movable with respect to the blade assembly along a moving direction parallel to the contact slot; and a housing formed of an insulative material and including a housing base and a housing cover slidable with respect to the housing base between a start position and a mounting position, the blade assembly is disposed within the housing base and the biasing element is disposed within the housing cover, a cable is inserted into the housing in the start position and the cable is electrically connected with the blade assembly in the mounting position, the housing cover has a retention spring contacting a jacket of the cable and retaining the cable in the housing.

* * * * *